US007738814B2

(12) United States Patent
Matsuura et al.

(10) Patent No.: US 7,738,814 B2
(45) **Date of Patent: *Jun. 15, 2010**

(54) DEVELOPMENT APPARATUS, IMAGE-FORMING APPARATUS AND DEVELOPING METHOD USING REVERSE POLARITY PARTICLES

(75) Inventors: Masahiko Matsuura, Suita (JP); Toshiya Natsuhara, Takarazuka (JP); Junya Hirayama, Takarazuka (JP); Takeshi Maeyama, Kawanishi (JP); Shigeo Uetake, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 574 days.

This patent is subject to a terminal disclaimer.

(21) Appl. No.: 11/584,891

(22) Filed: Oct. 23, 2006

(65) Prior Publication Data

US 2007/0092306 A1 Apr. 26, 2007

(30) Foreign Application Priority Data

Oct. 26, 2005 (JP) ..... 2005-310987

(51) Int. Cl.
*G03G 15/09* (2006.01)

(52) U.S. Cl. ..... 399/253; 399/270; 399/272; 399/273

(58) Field of Classification Search ..... 399/253, 399/254, 267, 272–274, 270
See application file for complete search history.

(56) References Cited

U.S. PATENT DOCUMENTS 4,639,115 A * 1/1987 Lin ..... 399/253
5,231,458 A 7/1993 Nishimura et al.
5,391,455 A * 2/1995 Bigelow ..... 399/254
5,506,372 A * 4/1996 Guth et al. ..... 399/254
5,802,430 A 9/1998 Wada
5,991,587 A 11/1999 Kikuchi
6,463,245 B1 10/2002 Suwa et al.
6,512,909 B2 1/2003 Ozawa et al.
6,721,516 B2 4/2004 Aoki et al.

(Continued)

FOREIGN PATENT DOCUMENTS

EP 654 714 A 1/1994

(Continued)

OTHER PUBLICATIONS

Partial European Search Report dated Dec. 8, 1996 issued in EP Patent Application No. EP 06019262.

(Continued)

*Primary Examiner*—William J Royer
(74) *Attorney, Agent, or Firm*—Brinks Hofer Gilson & Lione

(57) ABSTRACT

A development apparatus and an image forming apparatus capable of minimizing deterioration of a carrier for a long time, even in a case of continuous formation of images of a smaller image area ratio. The charging of toner is assisted by using a developer composed of a mixture of toner and the carrier, to the surface of which is added a reverse polarity particle having a polarity reverse to that of a charged toner. Separation of the toner or reverse polarity particle of the developer prior to a process of development prevents the reverse polarity particle from being consumed in a developing area, whereby an effect thereof is maintained for a long time.

19 Claims, 3 Drawing Sheets

U.S. PATENT DOCUMENTS

| | | | |
|---|---|---|---|
| 2004/0228661 | A1 | 11/2004 | Fujishima et al. |
| 2007/0092306 | A1 | 4/2007 | Matsuura et al. |

FOREIGN PATENT DOCUMENTS

| | | | |
|---|---|---|---|
| EP | 0 772 097 | A2 | 5/1997 |
| EP | 1 324 149 | A2 | 7/2003 |
| JP | 59-100471 | | 6/1984 |
| JP | 06 295123 | A | 10/1994 |
| JP | 09-185247 | | 7/1997 |
| JP | 2000-298396 | | 10/2000 |
| JP | 2002-108104 | | 4/2002 |
| JP | 2003-057882 | | 2/2003 |
| JP | 2003-215855 | | 7/2003 |
| JP | 2005-189708 | | 4/2005 |

OTHER PUBLICATIONS

Partial European Search Report dated May 9, 2007 issued in EP Patent Application No. EP 06019262.

Non-final Office Action dated Aug. 7, 2009 issued in related U.S. Appl. No. 11/805,815.

Non-final Office Action dated Apr. 3, 2009 issued in related U.S. Appl. No. 11/519,597.

Final Office Action dated Nov. 10, 2009 issued in related U.S. Appl. No. 11/519,597.

* cited by examiner

DEVELOPMENT APPARATUS, IMAGE-FORMING APPARATUS AND DEVELOPING METHOD USING REVERSE POLARITY PARTICLES

This application is based on Japanese Patent Application No. 2005-310987 filed on Oct. 26, 2005, in the Japanese Patent Office, the entire content of which is hereby incorporated by reference.

TECHNICAL FIELD

This invention relates to development apparatus and an image-forming apparatus for developing an electrostatic latent image formed on an image supporting member with developer including toner and carrier.

BACKGROUND

Conventionally, with respect to a developing system for an electrostatic latent image formed on an image supporting member in an image-forming apparatus using an electrophotographic system, a one-component developing system that uses only toner as a developer and a two-component developing system that uses a toner and a carrier have been known.

In the one-component developing system, in general, the toner is allowed to pass through a regulating section that is constituted by a toner-supporting member and a regulating plate pressed onto the toner-supporting member so that the toner is charged and a desired thin toner layer is obtained; therefore, this system is advantageous from the viewpoints of simplifying and miniaturizing the system and of achieving low costs. In contrast, due to a strong stress in the regulating section, the toner is easily deteriorated to cause degradation in a toner charge-receiving property. Moreover, the regulating plate and the surface of the toner-supporting member are contaminated by the toner and externally additive agents, with the result that a charge-applying property to the toner is lowered to cause problems such as fogging and the subsequent short service life of the developing system.

In comparison with the one-component developing system, the two-component developing system, which charges the toner through a friction-charging process upon mixing with the carrier, can reduce the stress, and is advantageous in preventing toner deterioration. Moreover, the carrier serving as a charge-applying material to the toner has a greater surface area so that it is relatively resistant to contamination due to the toner and externally additive agents, and is advantageous in prolonging the system service life. However, even in the case of the two-component developer, the contamination on the carrier surface due to the toner and externally additive agents also occurs to cause reduction in the quantity of charge in toner after a long-term use, resulting in problems such as fogging and toner scattering; therefore, the system service life is not sufficient, and there is a strong demand for a longer service life.

To meet the demand, a few technologies for prolonging the life of the two component developer by preventing the carrier from deteriorating have been proposed (for example, Japanese Patent Application Laid-Open Publication No. 59-100471 and Japanese Patent Application Laid-Open Publication No. 2003-215855)

With respect to a method for prolonging the life of the two component developer, Japanese Patent Application Laid-Open Publication No. 59-100471 has disclosed a development apparatus in which a carrier, alone or together with a toner, is supplied little by little, while a deteriorated developer having a reduced electrostatic charge property (simply referred to as "charge property") is discharged in response to a supply so that the carrier is exchanged to prevent increase in the a ratio of a deteriorated carrier. In this device, since the carrier is exchanged, a reduction in the quantity of charge in toner due to the deteriorated carrier can be suppressed in a certain level, making it possible to provide a long service life. However, since a mechanism for collecting the discharged carrier is required, and since the carrier is used as a consumable supply, problems arise in costs, environmental preservation, and the like. Moreover, since a predetermined number of printing processes need to be repeated until a ratio of new and old carriers has been stabilized, there is a failure to maintain and effectively use the initial properties.

Japanese Patent Application Laid-Open Publication No. 2003-215855 has disclosed a two component developer composed of a carrier and a toner to which particles that exert a charge property with a reverse polarity to a toner charge polarity are externally added, and a developing method using such a developer. In the developing method of Japanese Patent Application Laid-Open No. 2003-215855, the reverse polarity-chargeable particles are added in an attempt to add functions as a polishing agent and spacer particles, and it describes that by the effect of removing spent matters on the carrier surface, the degradation preventive effect is obtained. Moreover, it also describes that in a cleaning unit in an image supporting member, a cleaning property is improved, and that a polishing effect of the image supporting member is obtained. However, in the disclosed developing method, the amounts of consumption in the toner and the reverse polarity-chargeable particles are different depending on an image area rate, and in particular, in a case of a small image area rate, the consumption of the reverse polarity-chargeable particles becomes excessive, causing degradation in a carrier deterioration preventive effect in a development apparatus.

SUMMARY

An objective of the present invention is to provide a development apparatus and an image-forming apparatus, which can prevent a carrier from deteriorating for a long time even in a case when an image having a comparatively small image area is continuously formed.

In view of the forgoing, one embodiment according to one aspect of the present invention is a development apparatus, comprising:

a developer tank which contains developer including toner and carrier for charging the toner, the carrier being externally added with reverse polarity particles to be charged opposite to a toner polarity;

a developer-supporting member which carries the developer on a surface thereof for conveying the developer in the developer tank toward a developing area; and a separating mechanism which separates the reverse polarity particles or the toner from the developer on the developer-supporting member at a position which is upstream of the developing area in a direction of conveying the developer.

According to another aspect of the present invention, another embodiment is an image forming apparatus, comprising:

an electrostatic latent image supporting member which supports an electrostatic latent image;

an image forming mechanism which forms the electrostatic latent image on the electrostatic latent image supporting member;

a development apparatus for developing the electrostatic latent image formed on the electrostatic latent image supporting member and converting the electrostatic latent image into a toner image; and a transfer mechanism which transfers the toner image on the electrostatic latent image supporting member to a copying medium.

According to another aspect of the present invention, another embodiment is a method for developing an electrostatic latent image with toner in a developing area, the method comprising;

a step for conveying developer contained in a developer tank toward the developing area by a developer-supporting member, the developer including the toner and a carrier externally added with reverse polarity particles to be charged opposite to a charge polarity of the toner;

a step for separating the reverse polarity particles from the developer on the developer-supporting member at a position which is upstream of the developing area in a direction of conveying the developer, thus the developer from which the reverse polarity particles are separated being conveyed to the developing area; and a step for returning the separated reverse polarity particles into the developer tank.

DETAILED DESCRIPTION OF THE PREFERRED EMBODIMENT

In the present invention, since the consumption of reverse polarity particles can be suppressed, it becomes possible to reduce influences caused by variations in an amount of consumption of reverse polarity particles depending on an image area rate, and consequently to prevent the reverse polarity particles from being excessively consumed, in particular when the image area rate is low (in which the toner consumption is small). Moreover, the reverse polarity particles can effectively compensate a carrier for its charging property, thereby making it possible to prevent degradation in the carrier for a long time as a result. For this reason, even in a case when an image having a comparatively small image area is continuously formed, a quantity of charge in toner can be maintained effectively for a long time.

First Embodiment

Referring to the Figures, the following description will discuss embodiments of the present invention.

Figure 1:
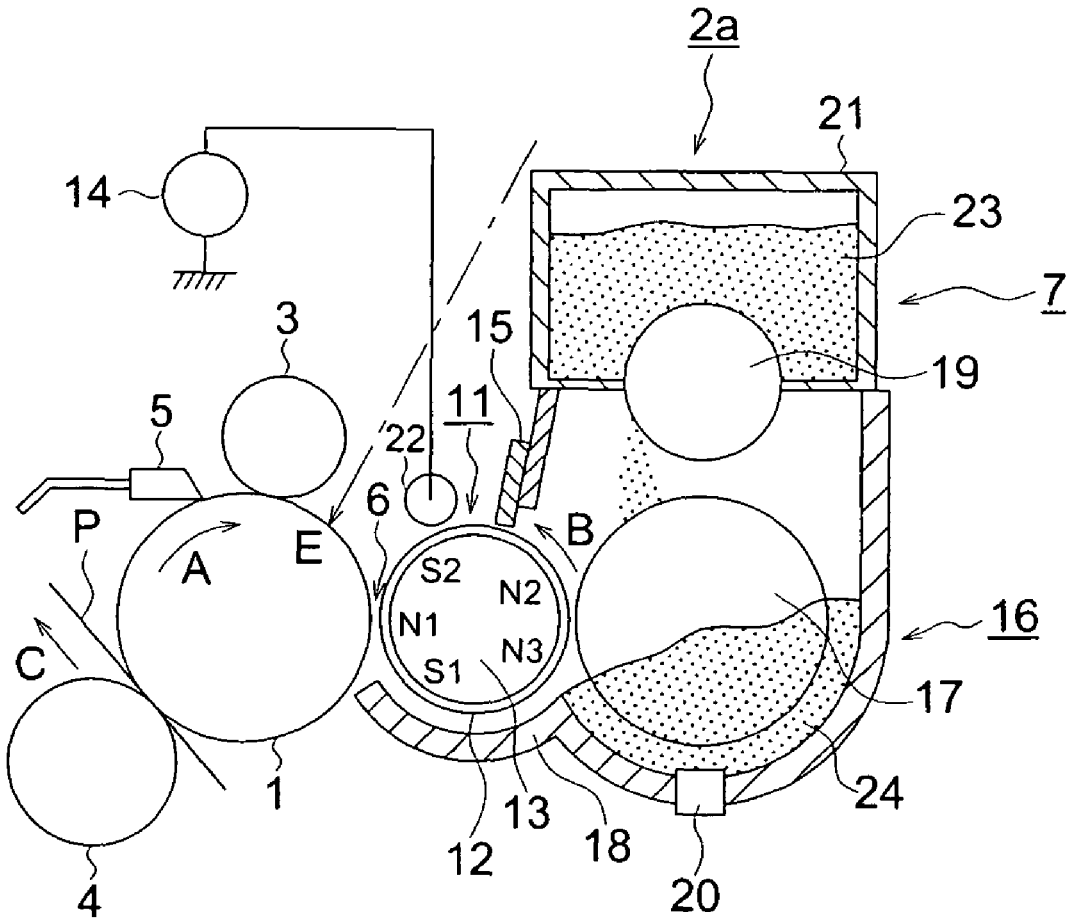
FIG. 1 is a schematic diagram that shows a main portion of an image-forming apparatus in accordance with one embodiment of the present invention.

FIG. 1 shows a main portion of an image-forming apparatus in accordance with one embodiment of the present invention. This image-forming apparatus is a printer which carries out an image-forming process by transferring a toner image formed on an image supporting member (photoconductive member) 1 onto a copying medium P such as paper through an electrophotographic system. This image-forming apparatus has an image supporting member 1 on which the image is supported, and on the periphery of the image supporting member 1, a charging member 3 serving as charging means used for charging the image supporting member 1, a development apparatus 2*a* used for developing an electrostatic latent image on the image supporting member 1, a transferring roller 4 used for transferring a toner image on the image supporting member 1 and a cleaning blade 5 used for removing residual toner from the image supporting member 1 are placed in succession along the rotational direction A of the image supporting member 1.

After having been charged by the charging member 3, the image supporting member 1 is exposed by an exposing device (not shown) provided with a laser light emitter or the like at a position indicated by point E in FIG. 1 so that an electrostatic latent image is formed on the surface thereof. The charging member 3 and the exposing device configure an image forming mechanism of the present invention. The development apparatus 2*a* develops this electrostatic latent image into a toner image. After transferring the toner image on the image supporting member 1 onto the copying medium P, the transferring roller 4 discharges the medium in the direction of arrow C in FIG. 1. The cleaning blade 5 removes residual toner on the image supporting member 1 after the transferring process by using its mechanical force. With respect to the image supporting member 1, the charging member 3, the exposing device, the transferring roller 4, the cleaning blade 5 and the like, those elements in a conventionally-known electrophotographic system may be optionally used. For example, a charging roller is shown in FIG. 1 as the charging means; however, a charging device used in a non-contact state to the image supporting member 1 may be used. Moreover, for example, the cleaning blade 5 may be omitted.

In the present embodiment, the development apparatus 2*a* is characterized by including a developer tank 16 housing a developer 24, a developer-supporting member 11 that supports the developer 24 supplied from the developer tank 16 on the surface, and transports the developer 24, a reverse polarity particle-separating member 22 that separates reverse polarity particles from the developer 24 on the developer-supporting member 11, and a power supply 14 that applies an electric voltage to the reverse polarity particle-separating member 22. The power supply 14 functions as a separation voltage applying section. An embodiment in which a toner-supporting member separates a toner particle will be described later.

The developer tank 16 is formed by a casing 18, and normally, houses a bucket roller 17 used for supplying the developer 24 to the developer-supporting member 11 therein. At a position facing the bucket roller 17 of the casing 18, an ATDC (Automatic Toner Density Control) sensor 20 used for detecting a toner density is preferably placed.

The developer-supporting member 11 is constituted by a magnetic roller 13 fixedly placed and a sleeve roller 12 that is freely rotatable and encloses the magnetic roller 13. The magnetic roller 13 has five magnetic poles N1, S1, N3, N2 and S2 placed along the rotation direction B of the sleeve roller 12. Among these magnetic poles N1, S1, N3, N2 and S2, the main magnetic pole N1 is placed at a position of a developing area 6 facing the image supporting member 1, and identical pole sections N3 and N2, which generate a repulsive magnetic field used for separating the developer 24 on the sleeve roller 12, are placed at opposing positions inside the developer tank 16.

The development apparatus 2*a* is normally provided with a supplying unit 7 used for supplying toner to be consumed in the developing area 6 into the developer tank 16, and a regulating member (regulating blade) 15 used for regulating a developer layer so as to regulate the amount of developer 24 on the developer supporting member 11. The supplying unit 7 is constituted by a hopper 21 housing a supply toner 23 and a supplying roller 19 used for supplying the supply toner 23 into the developer tank 16.

With respect to the supply toner 23, a toner to which reverse polarity particles have been externally added is preferably used. By using the toner to which reverse polarity particles have been externally added, it is possible to effectively compensate for a reduction in the charge property of the carrier that gradually deteriorates through a long-term use. The amount of the externally added reverse polarity particles in the supply toner 23 is preferably set in the range from 0.1 to 10.0% by mass, particularly from 0.5 to 5.0% by mass, with respect to the toner.

When the toner to which reverse polarity particles have been externally added is used as the supply toner 23, the supplying unit 7 functions as a supplying mechanism of the present invention.

Before describing the function and operation of the development apparatus 2*a*, the developer 24 which includes the reverse polarity particles used in the development apparatus 2*a* will be described.

In the present embodiment, the developer 24 contains a toner, a carrier used for charging the toner and reverse polarity particles. The reverse polarity particles can be charged with a reverse polarity to the toner charge polarity by the carrier to be used. For example, when the toner is negatively charged by the carrier, the reverse polarity particles are positively chargeable particles that are positively charged in the developer. When the toner is positively charged by the carrier, the reverse polarity particles are negatively chargeable particles that are negatively charged in the developer. By allowing the two-component developer to contain the reverse polarity particles, and by also allowing the separating mechanism to accumulate the reverse polarity particles in the developer during endurance use, the reverse polarity particles can also charge the toner to have a regular polarity, even in the case when the charge property of the carrier is lowered due to spent matters onto the carrier caused by the toner and post-treatment agent; therefore, it becomes possible to effectively compensate the charge property of the carrier, and consequently to prevent degradation in the carrier.

<Configuration of the Developer>

The configuration of the developer including the reverse polarity particles is described in detail bellow.

Reverse polarity particles to be desirably used are appropriately selected depending on the electrostatic charge polarity of the toner. In the case when a negatively chargeable toner is used as the toner, fine particles having a positively chargeable property are used as the reverse polarity particles, and examples thereof include: inorganic fine particles, such as strontium titanate, barium titanate and alumina, and fine particles composed of a thermoplastic resin or a thermosetting resin, such as acrylic resin, benzoguanamine resin, nylon resin, polyimide resin and polyamide resin, and a positive charge controlling agent used for providing a positive charge property to the resin may be added to the resin, or a copolymer of a nitrogen-containing monomer may be formed. With respect to the positive charge controlling agent, examples thereof include: nigrosine dyes and quaternary ammonium salts, and with respect to the nitrogen-containing monomers, examples thereof include: 2-dimethylaminoethyl acrylate, 2-diethylaminoethyl acrylate, 2-dimethylaminoethyl methacrylate, 2-diethylaminoethyl methacrylate, vinyl pyridine, N-vinyl carbazole and vinyl imidazole.

In contrast, in the case when a positive chargeable toner is used, fine particles having a positive charge property are used as the reverse polarity particles, and in addition to inorganic fine particles such as silica and titanium oxide, examples thereof include: fine particles composed of a thermoplastic resin or a thermosetting resin such as fluororesin, polyolefin resin, silicone resin and polyester resin, and a negative charge controlling agent used for providing a negative charge property may be added to the resin, or a copolymer of a fluorine-containing acrylic monomer or a fluorine-containing methacrylic monomer may be formed. With respect to the negative charge controlling agent, examples thereof include: salicylic acid-based or naphthol-based chromium complexes, aluminum complexes, iron complexes and zinc complexes.

In order to control the charge property and hydrophobic property of the reverse polarity particles, the surface of the inorganic fine particles may be surface-treated with a silane coupling agent, a titanium coupling agent, silicone oil or the like, and in particular, in the case when a positive charge property is applied to the inorganic fine particles, the particles are preferably surface-treated wirh an amino-group-containing coupling agent, and in the case when a negative charge property is applied, the particles are preferably surface-treated with a fluorine-group-containing coupling agent.

With respect to the toner, not particularly limited, conventionally-known toners generally used may be adopted, and a toner, formed by adding a colorant, or, if necessary, a charge controlling agent, a releasing agent or the like, to a binder resin, with an externally-added agent being applied thereto, may be used. With respect to the toner particle size, although not particularly limited, it is preferably set in the range from 3 to 15 μm.

Upon manufacturing such a toner, a conventionally-known method, generally used, may be used, and for example, a grinding method, an emulsion polymerization method, a suspension polymerization method and the like may be used.

With respect to the binder resin used for the toner, although not particularly limited to these, examples thereof include: styrene-based resin (homopolymer or copolymer containing styrene or a styrene-substituent), polyester resin, epoxy resin, vinyl chloride resin, phenol resin, polyethylene resin, polypropylene resin, polyurethane resin and silicone resin. A resin simple substance or a composite resin of these may be used, and those having a softening temperature in the range from 80 to 160° C. or those having a glass transition point in the range from 50 to 75° C. are preferably used.

With respect to the colorant, conventionally-known colorants, generally used, can be used, and examples thereof include: carbon black, aniline black, activated carbon, magnetite, benzene yellow, Permanent Yellow, Naphthol Yellow, Phthalocyanine Blue, Fast Sky Blue, Ultramarine Blue, Rose Bengale and Lake Red. In general, the colorant is preferably used at a rate of 2 to 20 parts by weight with respect to 100 parts by weight of the above-mentioned binder resin.

With respect to the charge controlling agent, any of conventionally-known agents may be used, and with respect to the charge controlling agent for positive chargeable toners, examples thereof include: nigrosine based dyes, quaternary ammonium salt compounds, triphenyl methane compounds, imidazole compounds and polyamine resin. With respect to the charge controlling agent for negative chargeable toners, examples thereof include: azo-based dyes containing metal, such as Cr, Co, Al and Fe, salicylic acid metal compounds, alkyl salicylic acid metal compounds and calix arene compounds. In general, the charge controlling agent is preferably used at a rate of 0.1 to 10 parts by weight with respect to 100 parts by weight of the above-mentioned binder resin.

With respect to the releasing agent, any of generally-used conventionally-known agents may be used, and examples thereof include: polyethylene, polypropylene, carnauba wax and sazol wax, and each of these may be used alone, or two or more kinds of these may be used in combination. In general, the releasing agent is preferably used at a rate of 0.1 to 10 parts by weight with respect to 100 parts by weight of the above-mentioned binder resin.

With respect to the externally additive agent, any of generally-used conventionally-known agents may be used, and fluidity-improving agents, for example, inorganic fine particles such as silica, titanium oxide and aluminum oxide and resin fine particles, such as acrylic resin, styrene resin, silicone resin and fluororesin, may be used, and in particular, those agents subjected to a hydrophobicizing treatment with a silane coupling agent, a titan coupling agent or silicone oil may be preferably used. The fluidity-improving agent is added at a rate of 0.1 to 5 parts by weight with respect to 100 parts by weight of the above-mentioned toner.

With respect to the carrier, not particularly limited, generally-used conventionally-known carriers may be used, and binder-type carriers, coat-type carriers and the like may be used. With respect to the carrier particle size, although not particularly limited, it is preferably set in the range from 15 to 100 μm.

The binder-type carrier has a structure in which magnetic material fine particles are dispersed in a binder resin, and positive or negative chargeable fine particles may be affixed onto the carrier surface or a surface coating layer may be formed. The charging properties such as a polarity of the binder-type carrier can be controlled by adjusting the material for the binder resin, the chargeable fine particles and the kind of the surface coating layer.

With respect to the binder resin used for the binder-type carrier, examples thereof include: thermoplastic resins, such as vinyl-based resins typically represented by polystyrene-based resins, polyester-based resins, nylon-based resins and polyolefin-based resins, and thermosetting resins such as phenol resins.

With respect to the magnetic material fine particles used for the binder-type carrier, magnetite, spinel ferrite such as gamma iron oxide, spinel ferrite containing one kind or two or more kinds of metals (Mn, Ni, Mg, Cu and the like) other than iron, magneto planbite-type ferrite, such as barium ferrite, and particles of iron or its alloy with an oxide layer formed on the surface may be used. The shape thereof may be any of a particle shape, a spherical shape and a needle shape. In particular, in the case when high magnetization is required, iron-based ferromagnetic fine particles are preferably used. From the viewpoint of chemical stability, ferromagnetic fine particles of magnetite, spinel ferrite, such as gamma iron oxide and of magneto planbite-type ferrite, such as barium ferrite, are preferably used. By appropriately selecting the kind and content of the ferromagnetic fine particles, it is possible to obtain a magnetic resin carrier having desired magnetization. The magnetic fine particles are preferably added to the magnetic resin carrier at an amount of 50 to 90% by mass.

The anchoring process of the chargeable fine particles or conductive fine particles onto the surface of the binder-type carrier is carried out, for example, through steps in which the magnetic resin carrier and the fine particles are mixed uniformly so that the fine particles are adhered to the surface of the magnetic resin carrier, and a mechanical impact and/or a thermal impact are then applied thereto so that the fine particles are driven into the magnetic resin carrier so as to be fixed thereon. In this case, the fine particles are not completely buried into the magnetic resin carrier, but fixed thereon with one portion thereof sticking out of the magnetic resin carrier surface. With respect to the chargeable fine particles, organic and inorganic insulating materials may be used. Specific examples of the organic-type include organic insulating fine particles of polystyrene, styrene-based copolymer, acrylic resin, various acrylic copolymers, nylon, polyethylene, polypropylene and fluororesin and crosslinked materials thereof, and with respect to the charging level and the polarity, by properly adjusting materials, polymerizing catalyst, surface treatment and the like, it is possible to obtain a desired charging level and a desired polarity. Specific examples of the inorganic-type include: negatively chargeable inorganic fine particles, such as silica and titanium oxide, and positively chargeable inorganic fine particles such as strontium titanate and alumina.

The coat-type carrier has a structure in which a resin coat is formed on carrier core particles made of a magnetic material, and in the same manner as the binder-type carrier, positively or negatively chargeable fine particles may be anchored onto the carrier surface. The charging properties such as polarity of the coat-type carrier can be controlled by adjusting the kind of the surface coating layer and the chargeable fine particles, and the same material as that of the binder-type carrier may be used. In particular, with respect to the coat resin, the same resin as the binder resin of the binder-type carrier may be used.

Figure 4:
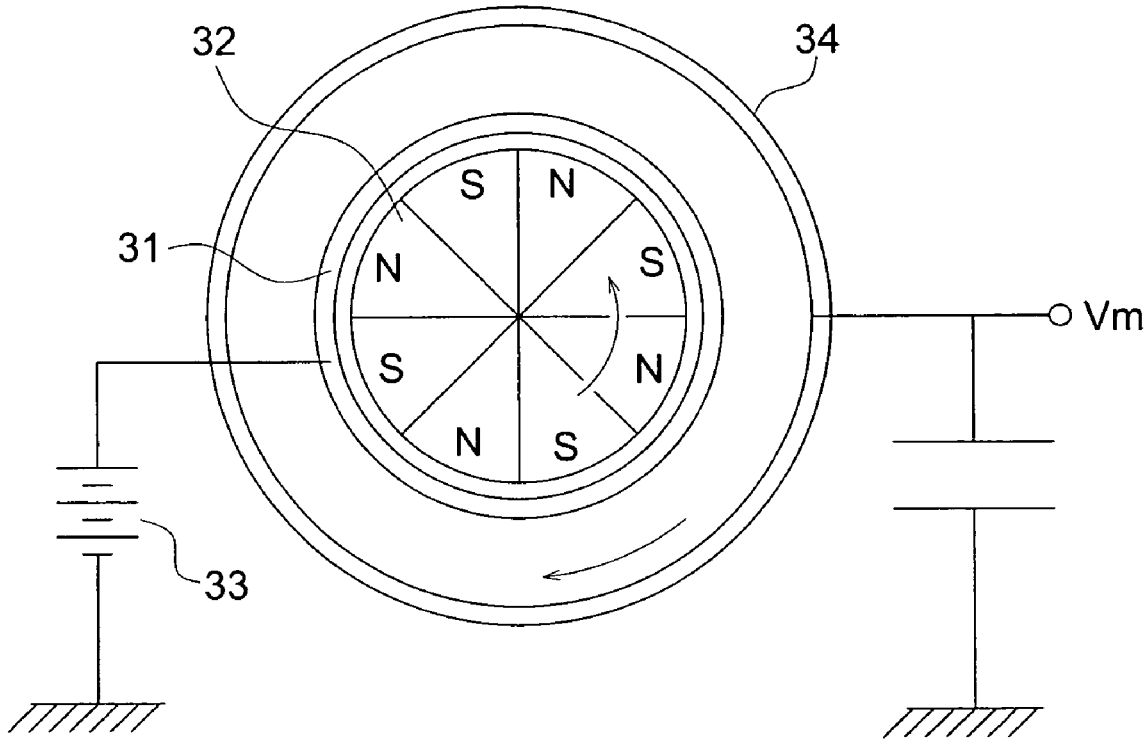
FIG. 4 is a schematic diagram that shows a measuring device of quantity of charge.

With respect to the electrostatic charge polarity of the toner and the reverse polarity particles in the combination with the reverse polarity particles, the toner and the carrier, after these materials have been mixed and stirred to form a developer, it is easily known by the direction of an electric used for separating the toner or the reverse polarity particles from the developer by using a device shown in FIG. 4. FIG. 4 is a schematic diagram of a measuring device of quantity of charge on charged particles such as toner.

With respect to the measurements on the quantity of charge in toner, the developer containing toner carrier and reverse polarity particles is placed on the entire surface of a conductive sleeve 31 uniformly, and the number of revolutions of a magnet roll 32, installed inside the conductive sleeve 31, is set to 1000 rpm. Then, a bias voltage of 2 kV with a polarity the same as that of the toner charging potential is applied from a bias power supply 33, and the conductive sleeve 31 is rotated for 15 seconds; thus, an electric potential Vm of a cylinder electrode 34 at the time when the conductive sleeve 31 is stopped is read, and the weight of toner adhered to the cylinder electrode 34 is measured by using a precision balance so that the quantity of charge in toner is found.

Further the polarity of added particles other than toner and carrier is determined from the polarity of the bias applied by the bias power supply 33. That is, when the bias voltage of the reverse polarity to the charged potential of the toner, the particles which are adhered to the cylinder electrode 34 is the reverse polarity particles with reversed charging polarity to the polarity of the toner charging potential.

The mixing ratio of the toner and the carrier is adjusted so as to obtain a desired quantity of charge in the toner. The toner ratio is usually set in the range from 3 to 50% by mass, preferably from 6 to 30% by mass, with respect to the total amount of the toner and the carrier.

Not particularly limited as long as the objective of the present invention is achieved, for example, the amount of the reverse polarity particles contained in the initial developer is preferably set in the range from 0.01 to 5.00% by mass with respect to the carrier.

The developer is prepared, for example, through processes in which after externally adding the reverse polarity particles to the carrier, the resulting carrier is mixed with the toner. The reverse polarity particles, being added to the carrier, are expected to constantly exist in the developer. That is, because the reverse polarity particles are bound to the carrier while they complement the charging ability of the carrier, there is no possibility that the reverse polarity particles are conveyed to the developing area and consumed there.

However, part of the reverse polarity particles may be consumed together with the toner being adhered to the toner in the long run. Thus, an element for separating and collecting the reverse polarity particles adhered to the surface of the toner is needed. Further, it is very effective for preventing from lowering the charging ability to externally add reverse polarity particles to the toner as well in the premise of separation. The amount of addition of the reverse polarity particles is preferable from 0.1 to 10% by mass, particularly from 0.5 to 5% by mass with respect to the toner.

<Function and Parathion of the Development Apparatus 2*a*>

The function and the operation of the development apparatus 2*a* which develops using the developer including above mentioned reverse polarity particles will be described.

More specifically, in the development apparatus 2*a* shown in FIG. 1, the developer 24 inside the developer tank 16 is mixed and stirred by rotation of the bucket roller 17, and after having been friction-charged, scooped by the bucket roller 17 to be supplied to the sleeve roller 12 on the surface of the developer-supporting member 11. The developer 24 is maintained on the surface side of the sleeve roller 12 by a magnetic force of the magnetic roller 13 inside the developer-supporting member (developing roller) 11, and rotated and shifted together with the sleeve roller 12, with the transmitting amount being regulated by the regulating member 15 placed face to face with the developing roller 11. Thereafter, at the portion facing the reverse polarity particle-separating member 22, only the reverse polarity particles contained in the developer 24 are separated and collected by the reverse polarity particle-collecting member 22. The remaining developer 24 from which the reverse polarity particles have been separated is transported to the developing area 6 facing the image supporting member 1. At the developing area 6, raised and aligned particles of the developer 24 are formed by a magnetic force of the main magnetic pole N1 of the magnetic roller 13, and an electric field, formed between an electrostatic latent image on the image supporting member 1 and the developing roller 11 to which a developing bias is applied, gives a force to the toner so that the toner in the developer 24 is moved to the electrostatic latent image side on the image supporting member 1; thus, the electrostatic latent image is developed into a visible image. The developing system may be an inversion developing system or may be a regular developing system. The developer 24 the toner of which has been consumed in the developing area 6 is transported toward the developer tank 16, and separated from the developing roller 11 by a repulsive magnetic field of the identical pole sections N3 and N2 of the magnetic roller 13 that are aligned face to face with the bucket roller 17, and collected into the developer tank 16. Upon detecting that the toner density in the developer 24 has become lower than the minimum toner density required for maintaining the image density from an output value of the ATDC sensor 20, a supply controlling unit, not shown, installed in the supplying unit 7, sends a driving start signal to the driving means of the toner supplying roller 19. Thus, the rotation of the toner supplying roller 19 is started, and by the rotation, the supply toner 23 stored in the hopper 21 is supplied into the developer tank 16. The reverse polarity particles, collected by the reverse polarity particle separating member 22, are returned onto the developing roller by inverting the direction of an electric field to be applied to the developing roller 11 and the reverse polarity particle-separating member 22 in the non-image forming state, and then transported together with the developer 24, following the rotation of the developing roller to be returned into the developer tank 16.

The reverse polarity particle-collecting member 22 may be designed to also serve as one of the regulating member 15 and the casing 18. In such a case, a reverse polarity particle-separating bias may be applied to the regulating member 15 and/or the casing 26. With this arrangement, it becomes possible to save spaces and achieve low costs.

When there is no binding force to the reverse polarity particles such as an externally adding process to the carrier, or the development apparatus does not have the separating member, the carrier deterioration preventive effect comes down in the development apparatus in case that image area rate is small. The mechanism is thought as follows.

In the two component development apparatus, a vibrating electric field is applied in the developing area to form an intense electric field so that the toner separation property and developing efficiency are improved. Thus, if the developer including reverse polarity particles is used, the carrier, the toner and the reverse polarity particles are separated, and the toner and the reverse polarity particles are consumed respectively in the electrostatic latent image and the non image area. Consequently, the consumption balance of the toner and the reverse polarity particles is not stable depending on the image area rate. It is thought that when a large amount of copies whose background area is large are printed, the reverse polarity particles in the developer are preferentially consumed, and the charging property of the carrier cannot be complemented, thus, the carrier deterioration preventive effect comes down.

<Separating Operation of the Reverse Polarity Particles>

In the configuration of the development apparatus 2*a* shown in FIG. 1, the method of separating and collecting the reverse polarity particles by the reverse polarity particle-separating member 22 will be described below.

In the development apparatus 2*a*, the reverse polarity particle-separating member 22 is adopted as a separating mechanism used for separating the toner or the reverse polarity particles from the developer 24 on the developer-supporting member 11. As shown in FIG. 1, the reverse polarity particle-separating member 22 is installed on the upstream side of the developing area 6 in the developer shifting direction on the developer-supporting member 11. That is because the reverse polarity particles are not necessary when developing as the reverse polarity particles function when mixing toner because the reverse polarity particles complement the carrier's ability of charging and contribute to charging the toner.

A predetermined reverse polarity particle separating bias is applied to the reverse polarity particle-separating member 22 that is connected to the power supply 14, which works as a separation voltage applying section, so that the reverse polarity particles in the developer 24 are electrically separated and collected on the surface of the reverse polarity particle-separating member 22. The reverse polarity particle-separating member 22 functions as an electric field forming member of the present invention. After the reverse polarity particles are separated by the reverse polarity particle-separating member 22, the remaining developer 24 on the developer-supporting member 11, or the toner and carrier, are kept being conveyed, and the electrostatic latent image on the image supporting member 1 is developed in the developing area 6.

The reverse polarity particle separating bias to be applied to the reverse polarity particle-separating member 22 is different depending on the electrostatic charge polarity of the reverse polarity particles; in other words, in the case when the toner is negatively charged with the reverse polarity particles being positively charged, the bias is a voltage having an average value lower than the average value of a voltage to be applied to the developer-supporting member 11, while in the case when the toner is positively charged with the reverse polarity particles being negatively charged, the bias voltage is a voltage having an average value higher than the average value of a voltage to be applied to the developer-supporting member 11. When the reverse polarity particles are charged to any of the positive polarity and the negative polarity, the difference between the average voltage to be applied to the reverse polarity particle separating member 22 and the average voltage to be applied to the developer-supporting member 11 is preferably set in the range from 20 to 500 V, particularly from 50 to 300 V. When the potential difference is too small, it becomes difficult to sufficiently collect the reverse polarity particles. In contrast, when the potential difference is too large, the carrier that is kept on the developer-supporting member 11 through a magnetic force is separated by an electric field, with the result that the inherent developing function in the developing area 6 tends to be impaired.

In the development apparatus 2*a*, an AC electric field is preferably formed between the reverse polarity particle separating member 22 and the developer-supporting member 11. The formation of the AC electric field allows the toner to reciprocally vibrate to effectively separate the reverse polarity particles adhered to the toner surface, making it possible to improve the collecting property of the reverse polarity particles.

<Application of the Separation Electric Field>

In the present specification, the electric field formed between the reverse polarity particle separating member 22 and the developer-supporting member 11 is referred to as a reverse polarity particle-separating electric field. Such a reverse polarity particle-separating electric field is normally obtained by applying an AC voltage to either the reverse polarity particle separating member 22 or the developer-supporting member 11 or to both of the members 22 and 11. In particular, in the case when an AC voltage is applied to the developer-supporting member 11 so as to develop the electrostatic latent image by the toner, it is preferable to form the reverse polarity particle-separating electric field by utilizing the AC voltage applied to the developer-supporting member 11.

For example, when the electrostatic charge polarity of the reverse polarity particles is positive and when a DC voltage and an AC voltage are applied to the developer-supporting member 11, with only a DC voltage being applied to the reverse polarity particle-separating member 22, only the DC voltage that is lower than the average value of the voltage (DC+AC) to be applied to the developer-supporting member 11 is applied to the reverse polarity particle-separating member 22. For another example, when the electrostatic charge polarity of the reverse polarity particles is negative and when a DC voltage and an AC voltage are applied to the developer-supporting member 11, with only a DC voltage being applied to the reverse polarity particle-separating member 22, only the DC voltage that is higher than the average value of the voltage (DC+AC) to be applied to the developer-supporting member 11 is applied to the reverse polarity particle-separating member 22.

For another example, when the electrostatic charge polarity of the reverse polarity particles is positive and when only a DC voltage is applied to the developer-supporting member 11, with an AC voltage and a DC voltage being applied to the reverse polarity particle-separating member 22, a DC voltage on which an AC voltage is superposed so as to have an average voltage lower than the DC voltage applied to the developer-supporting member 11 is applied to the reverse polarity particle-separating member 22. Furthermore, for example, when the electrostatic charge polarity of the reverse polarity particles is negative and when only a DC voltage is applied to the developer-supporting member 11, with an AC voltage and a DC voltage being applied to the reverse polarity particle-separating member 22, a DC voltage on which an AC voltage is superposed so as to have an average voltage higher than the DC voltage applied to the developer-supporting member 11 is applied to the reverse polarity particle-separating member 22.

For another example, when the electrostatic charge polarity of the reverse polarity particles is positive and when a DC voltage on which an AC voltage is superposed is applied to both of the developer-supporting member 11 and the reverse polarity particle-separating member 22, a voltage (DC+AC) having an average voltage smaller than the average voltage of a voltage (DC+AC) to be applied to the developer-supporting member 11 is applied to the reverse polarity particle-separating member 22. Moreover, for example, when the electrostatic charge polarity of the reverse polarity particles is negative and when a DC voltage on which an AC voltage is superposed is applied to both of the developer-supporting member 11 and the reverse polarity particle-separating member 22, a voltage (DC+AC) having an average voltage greater than the average voltage of a voltage (DC+AC) to be applied to the developer-supporting member 11 is applied to the reverse polarity particle-separating member 22.

Regarding the average voltage here, the amplitude, the phase, the frequency and the duty factor of the voltage applied to each member 11 and 22 are taken into consideration.

<Operation of Collection>

The reverse polarity particles separated and collected on the surface of the reverse polarity particle-separating member 22 are collected in the developer tank 16. Upon collecting the reverse polarity particles from the reverse polarity particle-separating member 22 into the developer tank 16, the large-small size relationship between the average value of the voltage to be applied to the reverse polarity particle-separating member 22 and the average value of the voltage to be applied to the developer-supporting member 11 is inverted, and this process is carried out at the time of non-image forming states, such as before the image forming process, after the image forming process and gaps between paper supplies (a page gap between the preceding page and the succeeding page) between image-forming processes during continuous operations. Thus, the reverse polarity particles are not consumed together with the toner when developing, are stirred and mixed with the developer 24 in the developer tank 16, and can keep playing the role of itself to contribute charging the toner.

<Configuration of the Separating Member>

With respect to the material for the reverse polarity particle-separating member 22, any material may be used as long as the above-mentioned voltage can be applied, and for example, an aluminum roller subjected to a surface treatment may be used. In addition to this, a member prepared by forming a resin coating or a rubber coating on a conductive base member such as aluminum by using the following materials may be used: Examples of the resin include: polyester resin, polycarbonate resin, acrylic resin, polyethylene resin, polypropylene resin, urethane resin, polyamide resin, polyimide resin, polysulfone resin, polyether ketone resin, vinyl chloride resin, vinyl acetate resin, silicone resin and fluororesin, and examples of the rubber include: silicone rubber, urethane rubber, nitrile rubber, natural rubber and isoprene rubber. The coating material is not intended to be limited by these. A conductive agent may be added to the bulk or the surface of the above-mentioned coating. With respect to the conductive agent, an electron conductive agent or an ion conductive agent may be used. With respect to the electron conductive agent, although not particularly limited by these, carbon black, such as Ketchen Black, Acetylene Black and Furnace Black, and fine particles of metal powder and metal oxide, may be used. With respect to the ion conductive agent, although not particularly limited by these, cationic compounds such as quaternary ammonium salts, amphoteric compounds and other ionic polymer materials are listed. A conductive roller made of a metal material such as aluminum may be used.

Second Embodiment

Figure 2:
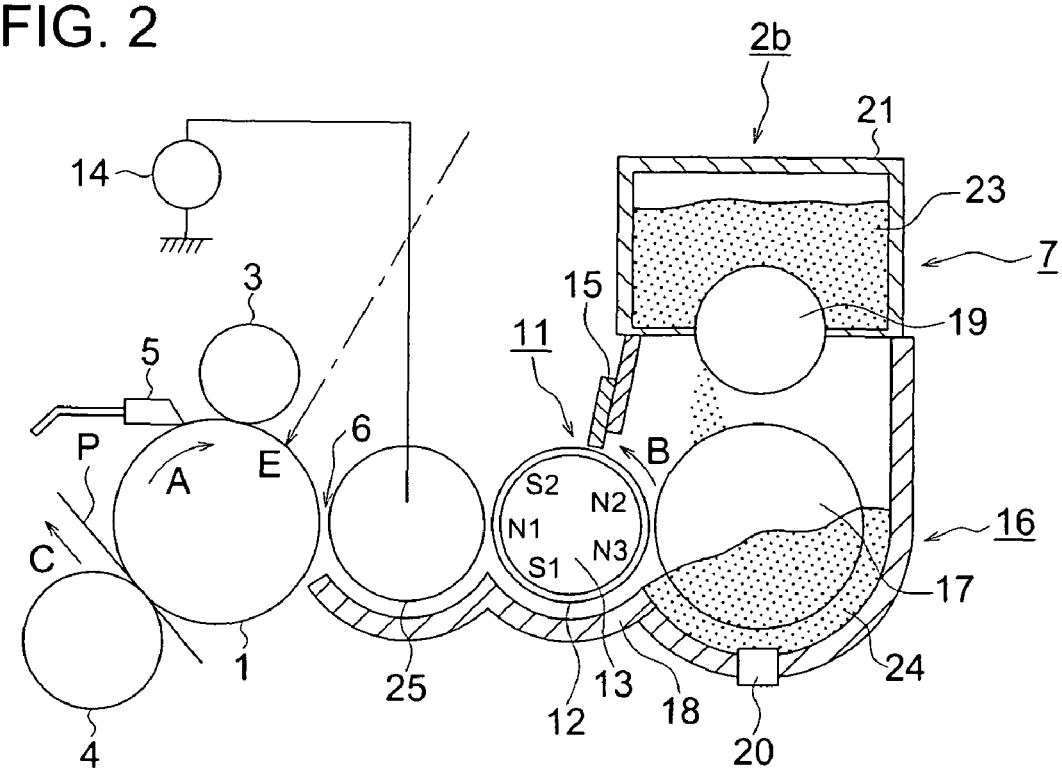
FIG. 2 is a schematic diagram that shows a main portion of an image-forming apparatus in accordance with another embodiment of the present invention.

FIG. 2 shows a main portion of an image-forming apparatus in accordance with another embodiment of the present invention. In FIG. 2, those members having the same functions as those shown in FIG. 1 are indicated by the same reference numerals, and the detailed description thereof is omitted.

<Configuration of Image Forming Apparatus>

Where the configuration, function and operation of the embodiment shown in FIG. 2 are different from the case of FIG. 1 is a development apparatus 2*b* particularly a part relevant to a separating mechanism. A toner-supporting member 25 is provided as the separating mechanism, in the development apparatus 2*b* shown in FIG. 2, and has a function of separating toner from a developer 24, while a reverse polarity particle-separating member 22 is provided as the separating mechanism, in the development apparatus 2*a* shown in FIG. 1, and has a function of separating the reverse polarity particles from the developer 24.

<Function and Operation of the Development Apparatus 2*b*>

The function and the operation of the development apparatus 2*b* shown in FIG. 2 will be described bellow comparing the development apparatus 2*a* shown in FIG. 1.

In the development apparatus 2*b* shown in FIG. 2, the developer 24, in the developer tank 16, containing the reverse polarity particles, in the same way of the development apparatus 2*a* shown in FIG. 1, is mixed and stirred by rotation of the bucket roller 17, and after having been friction-charged, scooped by the bucket roller 17 to be supplied to the sleeve roller 12 on the surface of the developer-supporting member 11.

The developer 24 is maintained on the surface side of the sleeve roller 12 by a magnetic force of the magnetic roller 13 inside the developer-supporting member (developing roller) 11, and rotated and shifted together with the sleeve roller 12, with the transmitting amount being regulated by the regulating member 15 placed face to face with the developing roller 11.

Thereafter, at a portion facing the toner-supporting member 25 working as the separating mechanism, only the toner contained in the developer 24 is separated and supported by the toner-supporting member 25. This process will be described later.

The separated toner is transported to the developing area 6 facing the image supporting member 1. At the developing area 6, an electric field, formed between an electrostatic latent image on the image supporting member 1 and the toner-supporting member 25 to which a developing bias is applied, gives a force to the toner so that the toner on the toner-supporting member 25 is moved to the electrostatic latent image side on the image supporting member 1; thus, the electrostatic latent image is developed into a visible image. The developing system may be an inversion developing system or may be a regular developing system.

A toner layer on the toner-supporting member 25 passing by the developing area 6 is transported to the developer tank 16 after being supplied and collected by a magnetic brush disposed at a portion where the toner-supporting member 25 and developer-supporting member 11 are facing each other.

The developer 24, remaining on the developer-supporting member 11, the toner of which has been separated is transported toward the developer tank 16, and separated from the developer-supporting member 11 by a repulsive magnetic field of the identical pole sections N3 and N2 of the magnetic roller 13 that are aligned face to face with the bucket roller 17, and collected into the developer tank 16.

A supply controlling unit, not shown, installed in the supplying unit 7, in the same way of FIG. 1, sends a driving start signal to the driving means of the toner supplying roller 19 upon detecting that the toner density in the developer 24 has become lower than the minimum toner density required for maintaining the image density. Thus, the supply toner 23 is supplied into the developer tank 16.

<Toner Separating Operation>

Regarding the separating mechanism, the configuration, function and operation of the development apparatus 2*b* shown in FIG. 2 is different from FIG. 1. The toner separating method by the toner-supporting member 25 will be described below.

As the separating mechanism for separating the toner or the reverse polarity particles from the developer 24 on the developer-supporting member 11, the development apparatus 2*b* shown in FIG. 2 employs the toner-supporting member 25, which separates the toner from the developer 24, instead of the reverse polarity particle-separating member 22 shown in FIG. 1.

In the development apparatus 2*b* shown in FIG. 2, in place of the reverse polarity particle-separating member 22 shown in FIG. 1, the toner supporting member 25 that separates toner from the developer 24 on the developer-supporting member 11 and supports the toner is used as the separating mechanism used for separating toner or reverse polarity particles from the developer 24 on the developer-supporting member 11. As shown in FIG. 2, the toner-supporting member 25 is placed between the developer-supporting member 11 and the image supporting member 1, and is designed so that upon application of a toner separating bias thereto, the toner in the developer 24 is electrically separated and supported on the surface of the toner-supporting member 25. The toner, separated by the toner-supporting member 25 and supported thereon, is transported by the toner-supporting member 25, and used for developing an electrostatic latent image on the image supporting member 1 at the developing area 6.

As described above, different from the embodiment shown in FIG. 1, the development apparatus 2*b* does not separate reverse polarity particles from the developer 24, but allows the toner-supporting member 25 to separate the toner from the developer 24 and support the toner thereon, and the toner, separated and supported on the toner-supporting member 25, is used for developing an electrostatic latent image on the image supporting member 1.

The toner-supporting member 25 is connected to a power supply 14, which functions as a separation voltage applying section, and a predetermined toner-separating bias is applied thereto so that the toner in the developer 24 is electrically separated and supported on the surface of the toner-supporting member 25. The toner-supporting member 25 functions as an electric field forming member of the present invention.

<Application of the Separation Electric Field>

The toner separating bias to be applied to the toner-supporting member 25 is different depending on the electrostatic charge polarity of the toner; in other words, when the toner is negatively charged, a voltage having an average voltage higher than the average value of a voltage to be applied to the developer-supporting member 11 is applied. When the toner is positively charged, a voltage having an average voltage lower than the average value of a voltage to be applied to the developer-supporting member 11 is charged. In either of the cases when the toner is positively charged and when the toner is negatively charged, the difference between the average voltage to be applied to the toner-supporting member 25 and the average voltage to be applied to the developer-supporting member 11 is preferably set in the range from 20 to 500 V, particularly from 50 to 300 V. When the difference in the electric potentials is too small, the amount of toner on the toner-supporting member 25 becomes small, failing to provide a sufficient image density. When the difference in the electric potentials is too great, the carrier supported of the developer-supporting member 11 is separated by the electric field, thus, the inherent developing function may be deteriorated in the developing area 6.

In the development apparatus 2*b*, an AC electric field is preferably formed between the toner-supporting member 25 and the developer supporting member 11. Since the formation of the AC electric field allows the toner to reciprocally vibrate, it becomes possible to effectively separate the reverse polarity particles from the toner.

In the present specification, the electric field, formed between the toner-supporting member 25 and the developer-supporting member 11, is referred to as a toner-separating electric field. Such a toner-separating electric field is normally formed by applying an AC voltage to either the toner-supporting member 25 or the developer-supporting member 11, or to both of the toner-supporting member 25 and the developer-supporting member 11. In particular, when an AC voltage is applied to the toner-supporting member 25 so as to develop an electrostatic latent image by the toner, the toner-separating electric field is preferably formed by utilizing the AC voltage to be applied to the toner-supporting member 25.

For example, when the toner charge polarity is positive, with a DC voltage and an AC voltage being applied to the developer-supporting member 11, and when only a DC voltage is applied to the toner-supporting member 25, only the DC voltage lower than the average value of the voltage (DC+AC) to be applied to the developer-supporting member 11 is applied to the toner-supporting member 25. For example, when the toner charge polarity is negative, with a DC voltage and an AC voltage being applied to the developer-supporting member 11, and when only a DC voltage is applied to the toner-supporting member 25, only the DC voltage higher than the average value of the voltage (DC+AC) to be applied to the developer-supporting member 11 is applied to the toner-supporting member 25. In these cases, the maximum value in the absolute value of the toner-separating electric field is given by a value obtained by dividing the maximum value in the potential difference between the voltage (DC+AC) to be applied to the developer-supporting member 11 and the voltage (DC) to be applied to the toner-supporting member 25 by the gap of the closest point between the toner-supporting member 25 and the developer-supporting member 11, and the corresponding value is preferably set in the aforementioned range.

For another example, when the toner charge polarity is positive, with only a DC voltage being applied to the developer-supporting member 11, and when an AC voltage and a DC voltage are applied to the toner-supporting member 25, a DC voltage on which an AC electric field is superposed so as to form an average voltage lower than the DC electric field to be applied to the developer-supporting member 11 is applied to the toner-supporting member 25. For another example, when the toner charge polarity is negative, with only a DC voltage being applied to the developer-supporting member 11, and when an AC voltage and a DC voltage are applied to the toner-supporting member 25, a DC voltage on which an AC electric field is superposed so as to form an average voltage higher than the DC electric field to be applied to the developer-supporting member 11 is applied to the toner-supporting member 25.

For another example, when the toner charge polarity is positive, with a DC voltage on which an AC voltage is superposed being applied to each of the developer-supporting member 11 and the toner-supporting member 25, the voltage (DC+AC) having an average voltage smaller than the average voltage of a voltage (DC+AC) to be applied to the developer-supporting member 11 is applied to the toner-supporting member 25. For another example, when the toner charge polarity is negative, with a DC voltage on which an AC voltage is superposed being applied to each of the developer-supporting member 11 and the toner-supporting member 25, the voltage (DC+AC) having an average voltage larger than the average voltage of a voltage (DC+AC) to be applied to the developer-supporting member 11 is applied to the toner-supporting member 25.

Regarding the average voltage here, the amplitude, the phase, the frequency and the duty factor of the voltage applied to each member 11 and 25 are taken into consideration.

<Operation of Collection>

The remaining developer 24 on the developer-supporting member 11 from which the toner has been separated by the toner-supporting member 25, that is, the carrier and reverse polarity particles, as they are, are transported by the developer-supporting member 11, and collected in the developer tank 16. Which means that it is only toner that is conveyed to the developing area 6, and the reverse polarity particles are not only conveyed to the developing area 6 but also consumed. In the present embodiment, after the separation of the toner, the reverse polarity particles, as they are, are collected in the developer tank 16 by the developer-supporting member 11; therefore, the process, used for returning the reverse polarity particles collected by the reverse polarity particle-collecting member 22 to the developer tank 16 during a non-image forming process, explained in the embodiment of FIG. 1, can be omitted.

As described above, the reverse polarity particles are not consumed together with the toner when developing, are stirred and mixed with the developer 24 in the developer tank 16, and can keep playing the role of itself to contribute charging the toner.

<Configuration of the Toner-Supporting Member>

With respect to the toner-supporting member 25, any material may be used as long as the above-mentioned voltage can be applied, and, for example, an aluminum roller that has been subjected to a surface treatment may be used. In addition to this, a member prepared by forming a resin coating or a rubber coating on a conductive base member such as aluminum by using the following materials may be used: Examples of the resin include: polyester resin, polycarbonate resin, acrylic resin, polyethylene resin, polypropylene resin, urethane resin, polyamide resin, polyimide resin, polysulfone resin, polyether ketone resin, vinyl chloride resin, vinyl acetate resin, silicone resin and fluororesin, and examples of the rubber include: silicone rubber, urethane rubber, nitrile rubber, natural rubber and isoprene rubber. The coating material is not intended to be limited by these. A conductive agent may be added to the bulk or the surface of the above-mentioned coating. With respect to the conductive agent, an electron conductive agent or an ion conductive agent may be used. With respect to the electron conductive agent, although not particularly limited by these, carbon black, such as Ketchen Black, Acetylene Black and Furnace Black, and fine particles of metal powder and metal oxide, may be used. With respect to the ion conductive agent, although not particularly limited by these, cationic compounds such as quaternary ammonium salts, amphoteric compounds and other ionic polymer materials are listed. A conductive roller made of a metal material such as aluminum may be used.

PRACTICAL EXAMPLE

A result of practice using the development apparatus 2*a* and 2*b* of FIG. 1 and FIG. 2 will be described as follows. Each case employs the reverse polarity particle-collecting member 22 and the toner-supporting member 25 respectively.

Table 1 to Table 3 show the developer and experimental conditions as well as evaluation results. The used developer and experimental conditions will be described later in detail.

The evaluation method is as follows.

An endurance test was conducted, where 10,000 copies of an image area ratio of 2% are printed in a 3 copy intermittent mode in each experimental condition by using a copier manufactured by Konica Minolta Business Technologies, Inc. (part number: bizhub C350). This mode is an evaluation method assuming general use condition of a common user, the mode which repeats a job of printing continuously 3 copies with character pattern (printing ratio of 2%) thereon followed by a short-time stop. Table 1 to Table 3 show charge quantity of the toner sampled from the developer tank at each point of the endurance test. Each image forming apparatus is supplied with toner described in each experimental condition.

Examples 1-1, 1-2, 2-1 and 2-2 and Comparative Examples

The following carrier and toner were used to evaluate the Examples 1-1, 1-2, 2-1 and 2-2, and Comparative Examples.

Developer Used in Example 1-1, 1-2, 2-1, 2-2 and Comparative Examples

Carrier A: The carrier A was a carrier dedicated to bizhub C350, a copying machine manufactured by Konica Minolta Business Technologies, Inc. This is a coated carrier composed of the carrier core particles made of a magnetic substance coated with silicone resin, having a volume average particle size of about 33 μm.

Carrier B: The carrier B was prepared by dispersing hydrophobic strontium titanate particles (2% by mass) as particles of reverse polarity in the carrier A for one hour with a paint conditioner (No. 5400: manufactured by Red Devil Inc.)

The hydrophobic strontium titanate particles used here were prepared by the steps of: adding $SrCl_2$ of the same molar quantity as that of $TiO_2$ to a slurry of metatitanic acid obtained by sulfuric acid method; then blowing $CO_2$ gas in the molar quantity two times that of $TiO_2$ at a flow rate of 1 L/min.; adding aqueous ammonia (wherein the pH value was 8) at the same time; rising the precipitate in water, drying it at 110° C. for one day, and sintering at 900° C. The number average particle size was 300 nm.

Toner B: The toner B was preparing by externally adding the first hydrophobic silica (0.2% by mass), the second hydrophobic silica (0.5% by mass), and hydrophobic titanium oxide (0.5% by mass) to the toner base material having a particle size of about 6.5 μm formed by wet pelletization method, by surface treatment at a speed of 40 m/s for three minutes. A Henschel mixer manufactured by Mitsui Mining and Smelting Co., Ltd. was used in this process. This process provided toner A of negative polarity, to start with.

The first hydrophobic silica used here was obtained by surface treatment of the silica having an average primary particle size of 16 nm (#130 by Nippon Aerosil Co., Ltd.), using hexamethyldisilazane (HMDS) as a hydrophobing agent. The second hydrophobic silica was obtained by surface treatment of the silica having an average primary particle size of 20 nm (#90G by Nippon Aerosil Co., Ltd.), using hexamethyldisilazane (HMDS). The hydrophobic titanium oxide was obtained by surface treatment of the anatase type titanium oxide having an average primary particle size of 30 nm, using the isobutyltrimethoxysilane as the aqueous wet type hydrophobing agent.

The aforementioned Henschel mixer was employed to externally add the hydrophobic strontium titanate (2% by mass) having a number average particle size of 300 nm as particles of reverse polarity to the toner base material particles contained in the toner A. This was done at a speed of 40 m/s for three minutes, thereby getting the toner B of negative polarity.

Examples 1-1 and 1-2, and Comparative Examples were evaluated under the following experimental conditions:

Experimental Conditions for Embodiment in the Examples 1-1 and 2-1 and Comparative Examples 1 and 3

In a development apparatus shown in FIG. 1, a combination of the aforementioned carrier and toner A or B was used as a developer. The proportion of toner in the developer was 8% by mass. The developer-supporting member was provided with a development bias of rectangular wave having an amplitude of 1.4 kV, DC component of −400 V, duty ratio of 50% and frequency of 2 kHz. For the average potential of the development bias, the potential difference of −150 V, namely, −550 V DC bias giving a potential difference of 850 V from the maximum potential of the development bias was applied to the reverse polarity particle separating member. An aluminum roller with the surface provided with alumite treatment was used as the reverse polarity particle-separating member. The gap between the closest position between the developer-supporting member and reverse polarity particle-separating member was 0.3 mm. The background potential of the electrostatic latent image formed on the image supporting member was −550 V and the potential of the image portion was −60 V. The gap between the closest position between the image supporting member and developer-supporting member was 0.35 mm. The maximum value of the absolute value of the electric field formed between the reverse polarity particle separating member and developer-supporting member was 850 V/0.3 mm=$2.8\times10^6$ V/m. The collection of the reverse polarity particles captured by the reverse polarity particle-separating member into a developer tank was carried out at a paper-to-paper timing by reversing the voltage applied to the developer-supporting member and reverse polarity particle-separating member.

Experimental Conditions for Embodiment in the Examples 1-2 and 2-2 and Comparative Examples 2 and 4

In a development apparatus shown in FIG. 2, a combination of the aforementioned carrier and toner A or B was used as a developer. The percentage of toner in the developer was 8% by mass. A d.c. voltage of −400 V was applied to the developer-supporting member. The toner-supporting member was provided with a development bias of rectangular wave having an amplitude of 1.6 kV, DC component of −300 V, duty ratio of 50% and frequency of 2 kHz. For the average potential of the development bias, the average potential of the toner-supporting member has a potential difference of 100 V, and the maximum potential difference is 900V. An aluminum roller with the surface provided with alumite treatment was used as the toner-supporting member. The gap of the closest position between the developer-supporting member and toner-supporting member was 0.3 mm. The background potential of the electrostatic latent image formed on the image supporting member was −550 V and the potential of the image portion was −60 V. The gap between the closest position between the image supporting member and toner-supporting member was 0.15 mm. The maximum value of the absolute value of the electric field formed between the toner-supporting member and developer-supporting member was 900 V/0.3 mm=$3.0\times10^6$ V/m.

Experimental Conditions of the Comparative Examples 5 and 6

Figure 3:
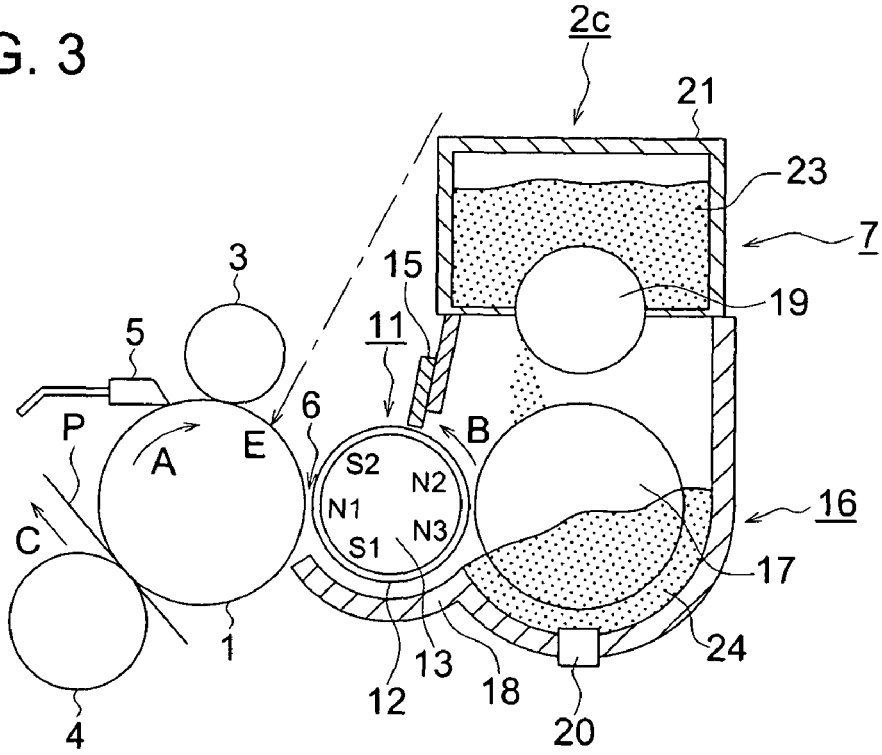
FIG. 3 shows a main portion of a comparative example of an image-forming apparatus.

The development apparatus 2*c* shown in FIG. 3 was used. The development apparatus 2*c* shown in FIG. 3 is the same as the development apparatus 2*a* shown in FIG. 1 except that the reverse polarity particle-separating member 22 and power source 14 were absent. A combination of the aforementioned carrier and toner B was used as the developer. The proportion of toner in the developer was 8% by mass. The developer-supporting member was provided with a development bias of rectangular wave having an amplitude of 1.4 kV, DC component of −400 V, duty ratio of 50% and frequency of 2 kHz. The background potential of the electrostatic latent image formed on the image supporting member was −550 V and the potential of the image portion was −60 V. The gap between the closest position between the developer-supporting member and reverse polarity particle-separating member was 0.35 mm.

Examples 1-1, 1-2, 2-1 and 2-2, and Comparative Examples were embodied for evaluation. Table 1 gives the result of evaluation in which the amount of change of the quantity of charge in toner is evaluated. The criteria of the evaluation was as follows, but the overall evaluation was made by considering both the evaluation at 50K copies and the evaluation at 100K copies and not always coincident with each evaluation.

A: the amount of change being 2.5 μC/g or less

B: the amount of change being 4.0 μC/g or less

C: the amount of change being 7.0 μC/g or less

D: the amount of change being more than 7.0 μC/g

TABLE 1

| | | | | Amount of static charge (−μc/g) | | | | | | | | | | |
|---|---|---|---|---|---|---|---|---|---|---|---|---|---|---|
| | *1 | Toner | Carrier | Initial | 5K sheets | 10K sheets | 30K sheets | 50K sheets | 100K sheets | *2 | *3 | *4 | *5 | *6 |
| Example 1-1 | a | B | B | 33.5 | 31.6 | 32.1 | 31.7 | 31.5 | 31.8 | 2.0 | A | 2.0 | A | A |
| Example 1-2 | b | B | B | 32.8 | 31.8 | 30.8 | 31.2 | 31.0 | 30.6 | 2.2 | A | 2.0 | A | A |
| Example 2-1 | a | A | B | 33.2 | 32.0 | 32.0 | 31.0 | 30.0 | 28.9 | 4.3 | C | 2.7 | B | B |
| Example 2-2 | b | A | B | 33.4 | 31.6 | 31.2 | 30.9 | 30.8 | 28.4 | 5.0 | C | 2.6 | B | B |
| Comp. -1 | a | B | A | 31.5 | 26.6 | 26.9 | 27.7 | 29.2 | 30.9 | 4.9 | C | 4.9 | C | C |
| Comp. -2 | b | B | A | 30.8 | 25.8 | 26.0 | 27.2 | 29.5 | 30.6 | 5.0 | C | 5.0 | C | C |
| Comp. -3 | a | A | A | 31.3 | 27.8 | 26.3 | 23.0 | 21.5 | 20.0 | 11.3 | D | 9.8 | D | D |
| Comp. -4 | b | A | A | 30.9 | 27.1 | 25.5 | 21.0 | 19.9 | 19.0 | 11.9 | D | 11.0 | D | D |
| Comp. -5 | one | B | A | 31.6 | 29.0 | 27.5 | 25.4 | 25.4 | 22.9 | 8.7 | D | 6.2 | C | D |
| Comp. -6 | one | B | B | 33.6 | 30.7 | 29.3 | 26.9 | 25.5 | 22.4 | 11.2 | D | 8.1 | D | D |

*1: Separating mechanism, *2: Variation at 100K, *3: Evaluation at 100K *4: Variation at 50K, *5: Evaluation at 50K, *6: Overall evaluation
"a" of the separating mechanism indicates a reverse polarity particle separation/collection member, and "b" denotes a toner-supporting member.

As shown in Table 1, in the Examples 1-1 and 1-2, the range of variation in the amount of static charge in toner with respect to the initial amount of static charge in toner when printing a large number of sheets did not exceed 2.5 μC/g. In the Examples 1-1 and 1-2, the range of variation in the amount of static charge in toner was very small. In the Comparative Examples 1 and 2, the range of variation in the amount of static charge in toner approximately reached the level of 5 μC/g.

In the Example 1-1 and Example 1-2 characterized by a very small change in the amount of static charge in toner, the developer used was the one wherein strontium titanate as reverse polarity particles was added to the carrier surface. Further, a strontium titanate collecting member and mechanism were provided. It can also be seen that processing of external addition of strontium titanate was applied to the toner to be supplied.

In the Examples 2-1 and 2-2, the strontium titanate used for treatment of the developer was accumulated onto the carrier, whereby initial variation was reduced. However, the amount of strontium titanate in the developer was gradually reduced by the consumption of the strontium titanate that could not have been separated. Accordingly, a slight reduction is observed for 100K. The amount of static charge is considered to reduce when the operation is performed for a longer time. Accordingly, excellent results can be obtained when compared with the developer without any reverse polarity particle added thereto. To ensure longer service life, reverse polarity particles are preferably added to the toner as well.

In the Comparative Examples 1 and 2, the strontium titanate as the reverse polarity particle was externally added to the toner, but no strontium titanate was added to the carrier surface. There was a substantial reduction in the amount of static charge in toner particularly in the initial phase.

In the Comparative Examples 3, 4 and 5, no strontium titanate was added to the carrier, and therefore, it can be seen that there was a substantial reduction in the amount of static charge in the initial phase. Moreover, since the reverse polarity particle was not added to toner in the Comparative Examples 3 and 4, and reverse polarity particles were added to the toner but there was no separation mechanism of reverse polarity particles in the Comparative Example 5, there was no accumulation of reverse polarity particles in the developer, with the result that deterioration of the carrier progressed gradually with the number of sheets. When the level of 100K was reached, a considerable reduction in the amount of static charge was observed.

In the Comparative Example 6, strontium titanate was added to the carrier, but there was no separating mechanism. Thus, it was soon consumed out of the development apparatus and a considerable reduction in the amount of static charge was observed.

As described above, when the developer made of a combination of the toner B and carrier B was used, the amount of static charge in toner is maintained with a high degree of stability in the phase ranging from the initial phase to the phase of printing a large number of sheets, by the action of the strontium titanate added to the carrier in the initial phase, by the action of the strontium titanate supplied with toner with the increase in the number of sheets printed, and by the member and mechanism provided for collecting the strontium titanate in the developer tank.

Examples 3 and 4

The following carrier and toner were used to evaluate the Examples 3 and 4.

Developer Used in Examples 3 and 4

Carrier C: The carrier C used in the Example was a coated carrier prepared by the steps of coating the carrier core particles of a magnetic substance with a silicone resin, and dispersing hydrophobic strontium titanate particles (2% by mass) in the carrier dedicated to a copying machine bizhub C350 manufactured by Konica Minolta Business Technologies, Inc. having a volume average particle size of about 33 μm, for one hour with a paint conditioner (No. 5400: manufactured by Red Devil Inc.).

The hydrophobic strontium titanate particles used here were prepared by the steps of: adding $SrCl_2$ of the same molar quantity as that of $TiO_2$ to a slurry of metatitanic acid obtained by sulfuric acid method; then blowing $CO_2$ gas in the molar quantity two times that of $TiO_2$ at a flow rate of 1 L/min.; adding aqueous ammonia (wherein the pH value was 8) at the same time; rising the precipitate in water, drying it at 110° C. for one day, and sintering at 700° C. The number average particle size was 70 nm.

Carrier D: Similarly to the case of the carrier C, the carrier D was prepared by dispersing hydrophobic strontium titanate particles (2% by mass) in the carrier dedicated to a copying machine bizhub C350 manufactured by Konica Minolta Business Technologies, Inc.

The hydrophobic strontium titanate particles used here was prepared by the steps of: adding $SrCl_2$ of the same molar quantity as that of $TiO_2$ to a slurry of metatitanic acid obtained by a sulfuric acid method; then blowing $CO_2$ gas in the molar quantity two times that of $TiO_2$ at a flow rate of 1 L/min.; adding aqueous ammonia (wherein the pH value was 8) at the same time; rising the precipitate in water, drying it at 110° C. for one day, and sintering at 800° C. The number average particle size was 100 nm.

Carrier B: The carrier B used in the Example 1-1 was used.

Carrier E: Similarly to the case of the carrier C, the carrier D was prepared by dispersing hydrophobic strontium titanate particles (2% by mass) in the carrier dedicated to a copying machine bizhub C350 manufactured by Konica Minolta Business Technologies, Inc.

The hydrophobic strontium titanate particles used here was were prepared by the steps of: adding $SrCl_2$ of the same molar quantity as that of $TiO_2$ to a slurry of metatitanic acid obtained by a sulfuric acid method; then blowing $CO_2$ gas in the molar quantity two times that of $TiO_2$ at a flow rate of 1 L/min.; adding aqueous ammonia (wherein the pH value was 8) at the same time; rising the precipitate in water, drying it at 110° C. for one day, and sintering at 1000° C. The number average particle size was 800 nm.

Carrier F: Similarly to the case of the carrier C, the carrier D was prepared by dispersing hydrophobic strontium titanate particles (2% by mass) in the carrier dedicated to a copying machine bizhub C350 manufactured by Konica Minolta Business Technologies, Inc.

The hydrophobic strontium titanate particles used here were prepared by the steps of: adding $SrCl_2$ of the same molar quantity as that of $TiO_2$ to a slurry of metatitanic acid obtained by a sulfuric acid method; then blowing $CO_2$ gas in the molar quantity two times that of $TiO_2$ at a flow rate of 1 L/min.; adding aqueous ammonia (wherein the pH value was 8) at the same time; rising the precipitate in water, drying it at 110° C. for one day, and sintering at 1100° C. The number average particle size was 850 nm.

Carrier B: The carrier B used in the Example 1-1 was used.

The following experimental conditions were used to evaluate the Examples 3 and 4.

Experimental Conditions of the Example 3

The development apparatus shown in FIG. 1 was utilized. A combination of the aforementioned carrier and toner B was used as a developer. Other conditions were the same as those of Example 1-1.

Experimental Conditions of the Example 4

The development apparatus shown in FIG. 2 was utilized. A combination of the aforementioned carrier and toner B was used as a developer. Other conditions were the same as those of Example 1-2.

Examples 3 and 4 were embodied and evaluated. The evaluation result is given in Table 2.

TABLE 2

| | | | | Amount of static charge (−μc/g) | | | | | | Max. | |
|---|---|---|---|---|---|---|---|---|---|---|---|
| | *1 | Toner | Carrier | Initial | 5K sheets | 10K sheets | 30K sheets | 50K sheets | 100K sheets | range of variation | Evaluation |
| Example 3-1 | a | B | C | 32.2 | 29.3 | 30.2 | 30.7 | 30.7 | 31.2 | 2.9 | B |
| Example 3-2 | a | B | D | 32.8 | 32.7 | 31.1 | 31.3 | 32 | 32.1 | 1.7 | A |
| Example 3-3 | a | B | B | 33.5 | 31.6 | 32.1 | 31.7 | 31.5 | 31.8 | 2 | A |
| Example 3-4 | a | B | E | 33.5 | 32 | 32.5 | 31.9 | 31 | 31.2 | 2.5 | A |
| Example 3-5 | a | B | F | 28.6 | 29.6 | 30 | 30.8 | 31 | 31.5 | 2.9 | B |
| Example 4-1 | b | B | C | 32.8 | 29.8 | 30.5 | 30.8 | 30.7 | 30.8 | 3 | B |
| Example 4-2 | b | B | D | 32.8 | 31.7 | 31.1 | 31.3 | 32 | 32.1 | 1.7 | A |
| Example 4-3 | b | B | B | 32.8 | 31.8 | 30.8 | 31.2 | 31 | 30.6 | 2.2 | A |
| Example 4-4 | b | B | E | 32.5 | 30 | 31 | 31 | 31 | 31.7 | 2.5 | A |
| Example 4-5 | b | B | F | 28.5 | 29.2 | 30 | 30.8 | 31 | 31.5 | 3 | B |

*1: Separating mechanism

"a" of the separating mechanism indicates a reverse polarity particle separation/collection member, and "b" denotes a toner carrier.

As shown in Table 2, in the Examples 3 and 4, when the number average particle size of the strontium titanate as the reverse polarity particle added to the carrier is in the range from 70 nm to 850 nm, a reduction was observed in the range of variation in the amount of static charge in toner during the printing of a large number of sheets, with respect to the initial amount of static charge in toner.

However, if the number average particle size is smaller than 100 nm as in the case of Example 3-1, when the strontium titanate having been added to the carrier is mixed with the toner in the developer tank, it migrates to the toner surface. The strontium titanate having migrated once will adhere firmly because it has a polarity reverse to that of the toner, and may be consumed together with toner.

When this number average particle size exceeds 850 nm as in Examples 3-5 and 4-5, the particle is difficult to fix on the carrier surface despite any addition to the carrier. The proportion of the strontium titanate particles suspended in the developer increases, and the suspended particles sticks to the surface of the toner, with the result that the amount of static charge in toner in the initial phase may be reduced.

The strontium titanate particle as the reverse polarity particle to be added to the carrier has a particular range of size wherein, even if the particle has migrated to the toner surface, the static-charge buildup of the toner is little affected, and the particle can be easily separated from the toner surface by the collection member or mechanism. Particularly in the range from 100 nm to 800 nm, the variation in the amount of static charge in toner during the printing of a large number of sheets is preferably very small with respect to the amount of static charge in toner in the initial phase.

Example 5 and 6

The following carrier and toner were used to evaluate Examples 5 and 6.

Developer Used in the Examples 5 and 6

Carrier G: The carrier G is a coated carrier prepared by the steps of coating the carrier core particles of a magnetic substance with a silicone resin, and dispersing hydrophobic strontium titanate particles (0.008% by mass) in the carrier dedicated to a copying machine bizhub C350 manufactured by Konica Minolta Business Technologies, Inc. having a volume average particle size of about 33 μm, for one hour with a paint conditioner (No. 5400: manufactured by Red Devil Inc.). The hydrophobic strontium titanate particles used in this case had a number average particle size of 300 nm, the same as that of the carrier B.

Carrier H: Similarly to the case of the carrier G, the carrier H was prepared by dispersing hydrophobic strontium titanate particles (0.01% by mass) in the carrier dedicated to a copying machine bizhub C350 manufactured by Konica Minolta Business Technologies, Inc. The hydrophobic strontium titanate particles used in this case had a number average particle size of 300 nm, the same as that of the carrier B.

Carrier I: Similarly to the case of the carrier G, the carrier I was prepared by dispersing hydrophobic strontium titanate particles (0.1% by mass) in the carrier dedicated to a copying machine bizhub C350 manufactured by Konica Minolta Business Technologies, Inc. The hydrophobic strontium titanate particles used in this case had a number average particle size of 300 nm, the same as that of the carrier B.

Carrier B: The carrier B of the Example 1-1 was used.

Carrier J: Similarly to the case of the carrier G, the carrier J was prepared by dispersing hydrophobic strontium titanate particles (5% by mass) in the carrier dedicated to a copying machine bizhub C350 manufactured by Konica Minolta Business Technologies, Inc. The hydrophobic strontium titanate particles used in this case had a number average particle size of 300 nm, the same as that of the carrier B.

Carrier K: Similarly to the case of the carrier G, the carrier K was prepared by dispersing hydrophobic strontium titanate particles (5.2% by mass) in the carrier dedicated to a copying machine bizhub C350 manufactured by Konica Minolta Business Technologies, Inc. The hydrophobic strontium titanate particles used in this case had a number average particle size of 300 nm, the same as that of the carrier B.

Carrier B: The carrier B of the Example 1-1 was used.

Examples 5 and 6 were evaluated under the following experimental conditions:

Experimental Conditions of the Example 5

The development apparatus shown in FIG. 1 was utilized. A combination of the aforementioned carrier and toner B was used as a developer. Other conditions were the same as those of Example 1-1.

Experimental Conditions of the Example 6

The development apparatus shown in FIG. 2 was utilized. A combination of the aforementioned carrier and toner B was used as a developer. Other conditions were the same as those of Example 1-2.

Examples 5 and 6 were embodied and evaluated. The evaluation result is given in Table 3.

TABLE 3

| | | | | Amount of static charge (−μc/g) | | | | | | Max. | |
|---|---|---|---|---|---|---|---|---|---|---|---|
| | *1 | Toner | Carrier | Initial | 5K sheets | 10K sheets | 30K sheets | 50K sheets | 100K sheets | range of variation | Evaluation |
| Example 5-1 | a | B | G | 32.3 | 29.5 | 30 | 30.5 | 30.9 | 31.5 | 2.8 | B |
| Example 5-2 | a | B | H | 33.3 | 32.5 | 31.8 | 31.6 | 32.1 | 31.4 | 1.9 | A |
| Example 5-3 | a | B | I | 33.3 | 32.5 | 31.5 | 31.8 | 31.9 | 31.4 | 1.9 | A |
| Example 5-4 | a | B | B | 33.5 | 31.6 | 32.1 | 31.7 | 31.5 | 31.8 | 2 | A |
| Example 5-5 | a | B | J | 29.1 | 30.6 | 30.4 | 31.2 | 31 | 31.5 | 2.4 | A |
| Example 5-6 | a | B | K | 28 | 28.3 | 28.7 | 29.8 | 30.1 | 30.9 | 2.9 | B |
| Example 6-1 | b | B | G | 32.3 | 29.3 | 30 | 30.2 | 30.8 | 31.7 | 3 | B |
| Example 6-2 | b | B | H | 33 | 31.5 | 30.8 | 31.5 | 32.1 | 31.4 | 2.2 | A |
| Example 6-3 | b | B | I | 33.8 | 32.5 | 31.5 | 31.8 | 31.9 | 31.4 | 2.4 | A |
| Example 6-4 | b | B | B | 32.8 | 31.8 | 30.8 | 31.2 | 31 | 30.6 | 2.2 | A |
| Example 6-5 | b | B | J | 30.1 | 29.2 | 29 | 30 | 30 | 31.1 | 2.1 | A |
| Example 6-6 | b | B | K | 27.3 | 28 | 28.1 | 29.3 | 29.6 | 30.3 | 3 | B |

*1: Separating mechanism

"a" of the separating mechanism indicates a reverse polarity particle separation/collection member, and "b" denotes a toner carrier.

As shown in Table 3, in the Examples 5 and 6, when the amount of the strontium titanate as the reverse polarity particle added to the carrier is in the range from 0.008 through 5.2% by mass, a reduction was observed in the range of variation in the amount of static charge in toner during the printing of a large number of sheets, with respect to the initial amount of static charge in toner.

If the amount of the strontium titanate added is lower than 0.01% by mass, there will be a reduction in the effect of increasing the amount of static charge of the toner. If the amount of the strontium titanate added is higher than 5% by mass, it will be difficult to fix all the strontium titanate particles onto the carrier surface. Thus, the proportion of the strontium titanate particles suspended in the developer increases, and the suspended particles sticks to the surface of the toner, with the result that the amount of static charge in toner in the initial phase may be reduced.

The strontium titanate particle as the reverse polarity particle to be added to the carrier has a preferred range in the amount to be added. Particularly in the range from 0.01 through 5% by mass, the variation in the amount of static charge in toner during the printing of a large number of sheets is preferably very small with respect to the amount of static charge in toner in the initial phase.

In the above description, hydrophobic strontium titanate was used as an Example. However, when negatively charged toner is used, it is also possible to use the particles exemplified by inorganic particles such as barium titanate and alumina, a thermoplastic resin such as acryl resin, nylon resin, polyimide resin and polyamide resin, or a thermosetting resin.

In the same manner, when positively charged toner is used, it is possible to use negatively charged particles as reverse polarity particles. For example, thermoplastic resin such as fluorine resin, polyolefin resin, silicone resin and polyester resin, or thermosetting resin, in addition to inorganic particles such as silica and titanium oxide.

It can easily be seen that excellent effects can be ensured by these particles if proper size and amount to be added are selected.

Particularly, inorganic particles of a high degree of hardness are preferably used because external additives and particle components of the toner other than the reverse polarity particle deposited on the carrier surface can be expected to be removed and polished by the inorganic particles.

As shown in the aforementioned Example, according to the embodiment of the present invention, the possible deterioration of the carrier is complemented by the toner electric charging effect of the reverse polarity particles. Further, the developer is used, which is prepared by mixing the toner with the carrier with the reverse polarity particle added to the surface thereon. The reverse polarity particles are separated from toner before development. This arrangement effectively prevents the reverse polarity particle from being consumed in the developing area, and allows the reverse polarity particle to perform its original function of contributing to charging the toner. Even in the case of continuous formation of the images having a smaller image area ratio, this arrangement minimizes the deterioration of the carrier for a long time. Such characteristics are ensured by the development apparatus and an image forming apparatus provided by the present invention.

It is to be expressly understood, however, that the aforementioned embodiments are only examples in all respects and should not be interpreted as restricting the present invention. The scope of the present invention is defined by the Claims of the present invention, not by the above description. The present invention is to be interpreted as including all the modifications according to the meaning defined by the Claims within the scope of the Claims.

What is claimed is:

1. A development apparatus, comprising:

a developer tank which contains developer including toner, carrier for charging the toner, and reverse polarity particles which are to be charged opposite to a toner polarity, the reverse polarity particles being externally added to the carrier;

a developer-supporting member which carries the developer on a surface thereof for conveying the developer in the developer tank toward a developing area; and a separating mechanism which separates the reverse polarity particles and the toner in the developer on the developer-supporting member from each other, at a position which is upstream of the developing area in a direction of conveying the developer.

2. The development apparatus of claim 1, wherein the separating mechanism includes an electric field forming member which is provided opposing the developer-supporting member for forming an electric field for separating the reverse polarity particles from the developer on the developer-supporting member.

3. The development apparatus of claim 2, wherein an AC electric field is formed between the electric field forming member and the developer-supporting member.

4. The development apparatus of claim 1, wherein the separating mechanism includes a toner-supporting member which is provided between the developing area and the developer-supporting member for separating the toner from the developer on the developer-supporting member and conveying the toner to the developing area.

5. The development apparatus of claim 4, wherein the toner is charged negative, and an average of a voltage applied to the toner-supporting member is higher than an average of a voltage applied to the developer-supporting member.

6. The development apparatus of claim 4, wherein the toner is charged positive, and an average of a voltage applied to the toner-supporting member is lower than an average of a voltage applied to the developer-supporting member.

7. The development apparatus of claim 4, wherein an AC electric field is formed between the toner-supporting member and the developer-supporting member.

8. The development apparatus of claim 1, wherein a number average particle size of the reverse polarity particles is from 100 nm to 800 nm.

9. The development apparatus of claim 1, wherein a percentage of the reverse polarity particles is from 0.01 to 5.00% by mass with respect to the carrier.

10. The development apparatus of claim 1, wherein the toner is externally added with reverse polarity particles to be charged opposite to a charge polarity of the toner.

11. The development apparatus of claim 1, comprising:

a supplying mechanism which supplies the reverse polarity particles to the developer in the developer tank.

12. The development apparatus of claim 11, wherein the supplying mechanism supplies toner for supply externally added with the reverse polarity particles into the developer tank.

13. The development apparatus of claim 12, wherein a percentage of the reverse polarity particles externally added to the toner for supply is from 0.5 to 5.0% by mass with respect to the toner.

14. The development apparatus of claim 1, wherein when the reverse polarity particles and the toner are separated from each other, the separated toner is collected on the separating mechanism, and the reverse polarity particles and the carrier are left on the developer-supporting member.

15. The development apparatus of claim 14, wherein the carrier left on the developer-supporting member are carried back to the developer tank by the developer-supporting member.

16. The development apparatus of claim 1, wherein when the reverse polarity particles and the toner are separated from each other, the separated toner is collected on the separating mechanism, and the reverse polarity particles and the carrier are left on the developer-supporting member.

17. An image forming apparatus, comprising:

an electrostatic latent image supporting member which supports an electrostatic latent image;

an image forming mechanism which forms the electrostatic latent image on the electrostatic latent image supporting member;

the development apparatus of claim 1 for developing the electrostatic latent image formed on the electrostatic latent image supporting member and converting the electrostatic latent image into a toner image; and a transfer mechanism which transfers the toner image on the electrostatic latent image supporting member to a copying medium.

18. A method for developing an electrostatic latent image with toner in a developing area, the method comprising:

a step for conveying developer contained in a developer tank toward the developing area by a developer-supporting member, the developer including the toner and carrier externally added with reverse polarity particles to be charged opposite to a charge polarity of the toner;

a step for separating the reverse polarity particles from the developer on the developer-supporting member with the toner and the carrier left on the developer-supporting member, at a position which is upstream of the developing area in a direction of conveying the developer, so that the toner and the carrier remain on the developer supporting member and are conveyed to the developing area; and a step for returning the separated reverse polarity particles into the developer tank.

19. A method for developing an electrostatic latent image with toner in a developing area, the method comprising:

a step for conveying developer contained in a developer tank toward the developing area by a developer-supporting member, the developer including the toner and carrier externally added with reverse polarity particles to be charged opposite to a charge polarity of the toner;

a step for separating the toner from the developer on the developer-supporting member with the reverse polarity particles and the carrier left on the developer-supporting member, at a position which is upstream of the developing area in a direction of conveying developer; and a step for conveying the separated toner to the developing area.

* * * * *